United States Patent [19]

Love

[11] 4,306,668

[45] Dec. 22, 1981

[54] BULK STORAGE SILO

[75] Inventor: Graham Love, Niagara Falls, Canada

[73] Assignees: Don Fell Limited; Gordon Fell Limited; Lawrence Fell Limited, all of Hamilton, Canada

[21] Appl. No.: 66,671

[22] Filed: Aug. 15, 1979

[30] Foreign Application Priority Data

Mar. 15, 1979 [CA] Canada ..... 323472

[51] Int. Cl.[3] ..... B65D 35/36

[52] U.S. Cl. ..... 222/105; 222/181; 222/183; 222/478; 141/18

[58] Field of Search ..... 222/105, 181, 183, 185, 222/131, 478, 189; 206/386, 600; 220/DIG. 27; 141/18

[56] References Cited

U.S. PATENT DOCUMENTS 2,660,341 11/1953 Norbom ..... 222/185
3,058,623 10/1962 Hawk et al. .

FOREIGN PATENT DOCUMENTS 113701 8/1908 Canada .
923093 3/1973 Canada .
2223996 12/1973 Fed. Rep. of Germany ... 220/DIG. 27
132853 11/1978 Fed. Rep. of Germany ..... 206/386
1509039 12/1967 France ..... 222/185
915705 1/1963 United Kingdom .
919825 2/1963 United Kingdom .
1207966 10/1970 United Kingdom .
1454996 11/1976 United Kingdom .
2014944 9/1979 United Kingdom .
2014965 9/1979 United Kingdom ..... 222/181

*Primary Examiner*—Allen N. Knowles

[57] ABSTRACT

A readily assembled and disassembled silo for the bulk storage of granular materials consists of a rigid, generally rectangular metal frame that supports a grid of interconnected horizontal and vertical bands of flexible webbing material extending between vertical posts and horizontal upper and lower bars. A flexible bag of woven polyolefin is supported within the metal frame and webbing grid. This bag has a filling tube near its top, discharge tubes near its bottom and a screened ventilator opening.

11 Claims, 7 Drawing Figures

BULK STORAGE SILO

BACKGROUND OF THE INVENTION

This invention relates to a portable silo or bulk storage system for the storage of free-flowing solid materials such as powders, grains, pellets or the like. For example the system is suitable for the bulk storage of salt, flour, sugar, green coffee, milk powder, corn starch and corn sugar powder, grain feeds, fertilizers, cement, nylon flakes, aluminum hydroxide and numerous resins such as polyester resin, polyethylene, polyvinyl chloride and others. For convenience such materials will be referred to below as "granular" materials.

The object of the invention is to provide an inexpensive and readily portable silo or bulk storage system that will nevertheless be reliable and easy to erect and use in practice. Bulk storage refers to the storage of quantities of the range of 10,000 lbs and up of a granular material. Traditionally such quantities have been stored in permanent, rigid silos which are expensive, bulky, heavy to move from place to place and not generally adapted for use indoors.

A prior proposal for a flexible storage bin is shown in U.S. Pat. No. 3,058,623 issued Oct. 16, 1962 to T. F. Hawk et al.

SUMMARY OF THE INVENTION

The purpose of the present invention is to provide improvements over this prior storage bin, especially in the area of simplicity of construction and ease of assembly and use.

To this end, the invention consists of a flexible bag silo for bulk storage of granular material, comprising (a) a generally rectangular metal frame; (b) a grid of interconnected bands of flexible material extending between parts of said frame; and (c) a flexible bag confined by said frame and said grid, said bag having at least one filling tube near the top thereof, at least one discharge tube near the bottom thereof and a ventilator opening near the top thereof.

Preferably, said frame is formed of vertical posts connected together by horizontal upper and lower bars, said bands of flexible material extending horizontally and vertically between said posts and bars respectively.

BRIEF DESCRIPTION OF THE DRAWINGS

The accompanying drawings illustrate one embodiment of the present invention. In these drawings.

DESCRIPTION OF THE PREFERRED EMBODIMENT

Figure 1:
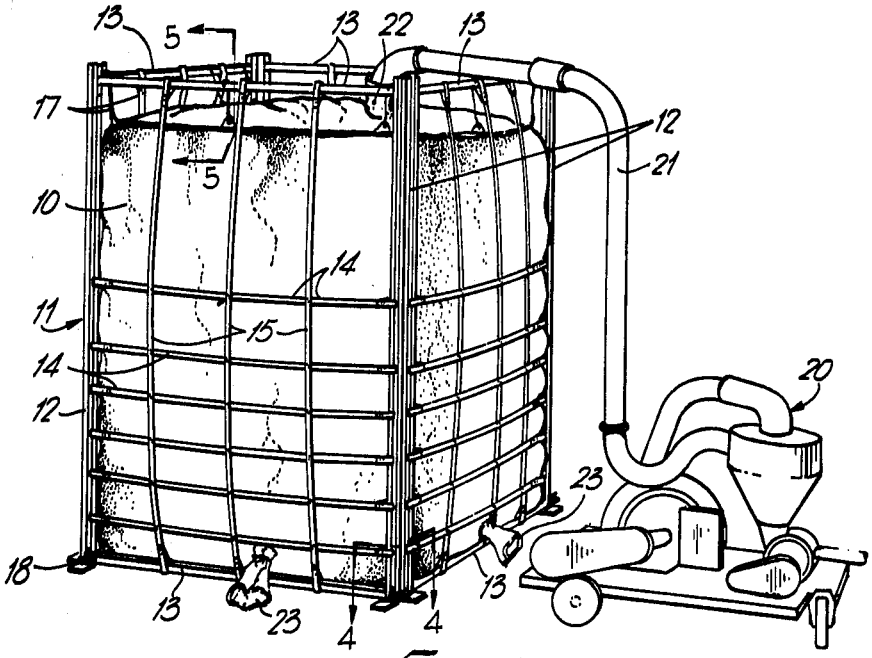
FIG. 1 is a perspective view of a silo system and associated blower.
Figure 3:
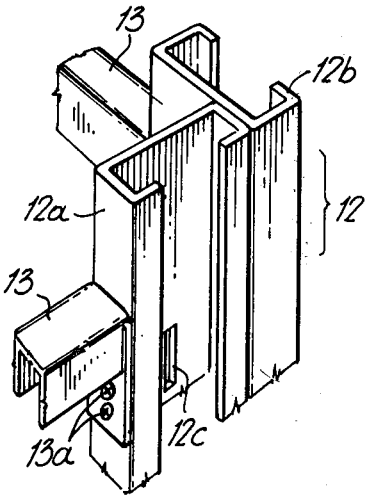
FIG. 3 is a fragmentary perspective view of a detail of construction.

The drawings show a flexible bag 10 supported within a frame 11 that consists of four vertical metal posts 12 joined together top and bottom by horizontal metal bars 13. Each post 12 consists of a pair of angled sections 12*a* and 12*b* bolted together, and provided with slots 12*c*.

Figure 4:
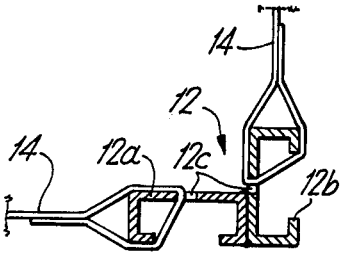
FIG. 4 is a fragmentary horizontal section taken on 4—4 in FIG. 1 and showing a further detail of construction.
Figure 2:
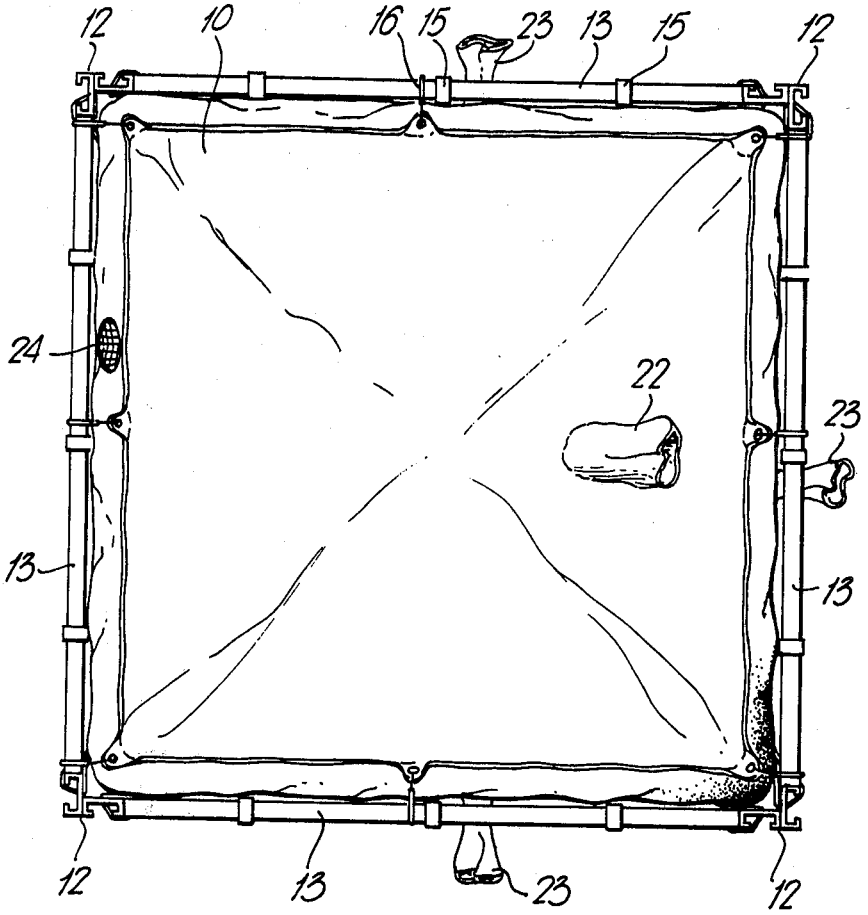
FIG. 2 is a plan view of the silo system of FIG. 1.

Between the posts 12 and the bars 13 there extends a grid of flexible webbing enclosing each side of the bag 10 and consisting of horizontal and vertical bands 14 and 15 of webbing material. Where these bands intersect they are stitched together so as to form a grid the shape of which is fixed, except that the webbing allows some bulging of the bag 10 when full. FIGS. 1, 2 and 4 show how the horizontal bands 14 are connected to the posts 12 and how the vertical bands 15 simply pass around the bars 13. As FIG. 1 shows, the spacing between band 14 may be closer near the bottom of the silo than near the top, to support the additional pressure inside the lower part of the bag 10.

The frame 11 defines an open-bottom peripheral framework adapted to be free-standing on a firm horizontal floor which supports the weight of the bag when full.

Figure 5:
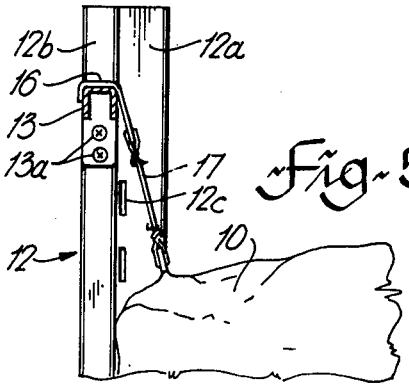
FIG. 5 is a fragmentary vertical section taken on 5—5 in FIG. 1 and showing yet another detail.

The top edge of the bag 10 is suspended from the upper bars 13 by means of hooks 16 and elastic cords 17, as shown on a larger scale in FIG. 5. The cords 17 serve merely to support the top edge of the bag when the latter is empty. When it is full, the weight of the contents rests on the floor and is not taken by the cords 17, which factor permits these cords to be elastic. The bottom corners of the bag 10 are connected by tie cords 18 to the bottoms of the posts 12 beneath the lower bars 13 to ensure uniform filling.

The bag 10 has a shape to conform to that of the frame 11, which is not necessarily rectangular in elevation and square in plan as shown in the drawings, although this is the preferred shape. The bag 10 is made of a woven polyolefin material, preferably the material sold under the Trade Mark Felcolene. Such material has great strength, resisting tearing and puncturing, and has the durability to store heavy loads indefinitely. On the other hand it is sufficiently translucent to enable the operator to see through it sufficiently to assess the approximate degree of fullness of the bag.

Such woven polyolefin material typically has a tensile strength of from about 130 to about 200 pounds per square inch, a tear strength of from about 40 to about 46 pounds, a puncture strength of from about 105 to about 145 pounds and a weight of from about 4 to about 5½ ounces per square yard.

A specific example of the silo system shown in the drawings consists of a frame 11 that is 12 feet high and 8 feet in each horizontal direction with a corresponding bag 10 capable of storing about 21,000 lbs of polyester resin. Since the bars 13 are connected by bolts 13*a* to the posts 12, the system can be readily assembled and disassembled and stored in a small space.

The system is preferably filled by means of a blower 20 which feeds the granular material through a tube 21 to a top loading tube 22 formed in the upper surface of the bag 10. The tube 22 is formed with a reinforced collar for strength and is of large diameter to enable rapid loading. Similarly reinforced discharge tubes 23 are formed on three of the four side walls of the bag at the bottom thereof. The provision of three such tubes makes the unloading process more versatile. Again the blower 20, now connected to one of the tubes 23, will normally be used for unloading the granular material. When not in use the tubes 22 and 23 are tied closed.

If desired, the bottom surface of the bag 10 can be provided with a similar discharge tube (not shown) for situations in which the silo is to be mounted in an elevated position. In such circumstances, the bottom of the frame can include additional cross members to help support the bag.

A further feature that can be included is a reinforcing panel, i.e. a second, inner layer of the polyolefin material secured to the central area of the inner surface of the bottom of the bag 10 to act as an impact layer to prevent excessive wear to the material of the bag bottom as a result of abrasion by granular material that is projected into the bag from the loading tube during the initial stages of filling. Once some material has accumulated on the bottom of the bag it protects the bag from abrasion by further material entering the bag at high velocity.

The bag 10 may be provided in its top surface or near the top of one of its side walls, e.g. the side wall not fitted with a discharge tube, with a ventilator 24 (FIG. 2), namely a fine screen that will permit the outflow and inflow of air during the filling and emptying processes respectively. In the case of some very fine granular materials, e.g. flour, such ventilator screen can be connected to an aspirator tube (not shown) leading to an appropriate location for collection of any material that escapes through the screen.

Figure 6:
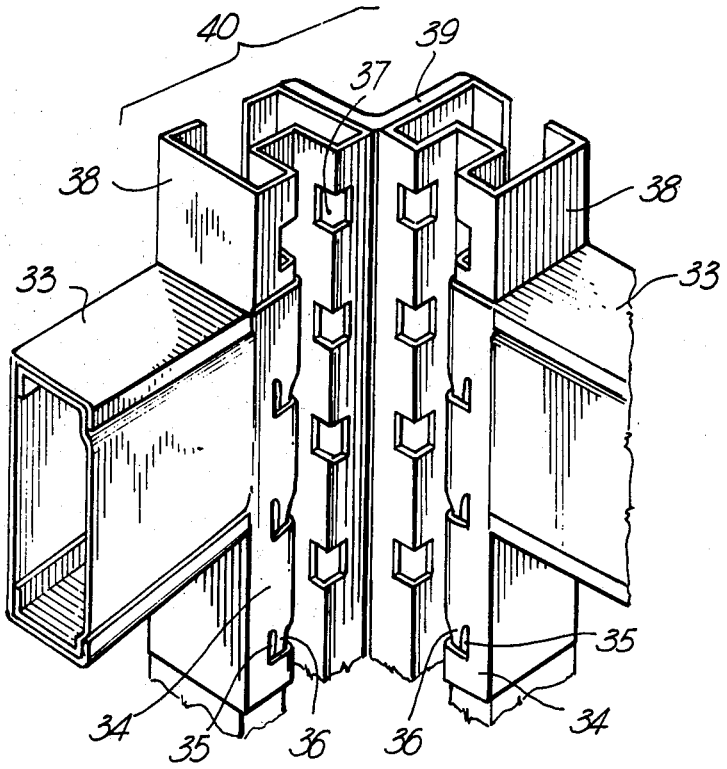
FIG. 6 is a perspective view of an alternative to FIG. 3, being a quick release manner of interconnecting the vertical posts and horizontal bars.

FIG. 6 shows an alternative, "quick-release" manner of interconnecting the horizontal bars and vertical posts. In this case, the bars 33 (replacing bars 13) are box-like and carry at their ends brackets 34 having cut out portions 35 with inwardly bent teeth 36 that engage in slots 37 formed in vertical rows along vertical members 38 which are joined together by an angle member 39 to form a composite vertical post 40 that will replace the posts 12. This construction is especially convenient for quick engagement and release, ready assembly and disassembly being an important aspect of the present construction.

Figure 7:
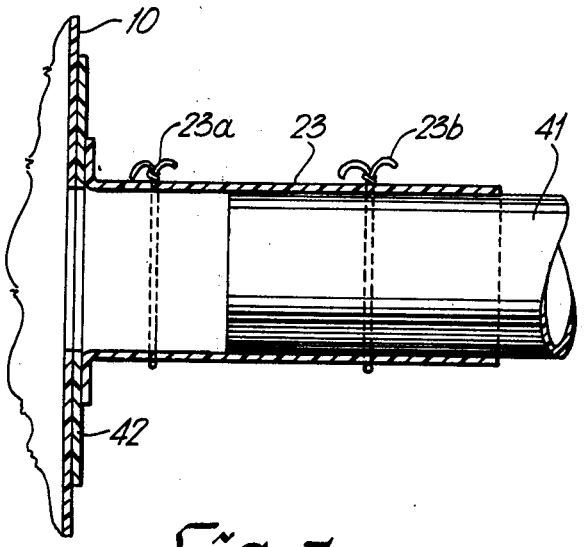
FIG. 7 is an enlarged sectional view of a modified form of discharge tube.

FIG. 7 shows a further, optional feature relating to the structure of the discharge tubes 23 which are provided with two ties 23*a* and 23*b*. When the tube is closed off, e.g. during filling and storage of material in the bag 10, the tie 23*a* nearer the bag is used, thus minimising the amount of material in the tube. When it is desired to discharge material from the bag, a tube 41 is inserted into the tube 23 and secured therein by the second tie 23*b*, whereupon the tie 23*a* is released. This is the situation shown in FIG. 7. The tube 41 will, of course, be connected to a suction side of the blower 20 or other device for unloading the bag pneumatically FIG. 7 also shows the further feature of reinforcing the area of the bag 10 around the discharge tube 23 by an additional, annular layer 42 of bag material.

Advantages of the present invention in relation to prior art structures, especially that shown in the U.S. Hawk patent referred to above, are as follows.

The present metal frame is essentially rectangular in form whether viewed from the front, the side or the top. This enables a number of such silos to be arrayed side-by-side or to be stacked with maximum utilisation of the space available. It also provides a very stable structure. Hawk, by contrast, discloses a frame that is circular in plan view and has legs that incline outwardly towards the ground. The feet of these legs are not interconnected and hence there is no provision against their splaying further under load. The frame disclosed herein, on the other hand, employs vertical posts, the feet of which are joined together by horizontal bars.

The manner of suspension of the inner flexible bag is also different. Hawk supports his bag from a central location at the top of his frame. The present structure supports the bag around its upper edges, e.g. the cords 17 and hooks 16 (FIGS. 2 and 5). The bag is thus supported by a peripheral, rectangular (square in the example) series of supports, i.e. the upper bars 13, which define a horizontal plane. This arrangement facilitates the use of a rectangular bag conformed in shape to the rectangular metal frame, with maximum utilisation of the space within the frame.

Moreover, the cords 17 are elastic, enabling them to act as shock absorbers during the filling process to distribute the load. In addition, the bottom corners of the bag are secured by tie cords 18 to the bottom corners of the frame. As a result, the bag 10 and the frame 11 by which it is confined, act as a unit, maintaining essentially the same shape whether the bag is full or empty. Of course, the bag can be collapsed when the frame is dismantled for shipping or storage, but at other times the bag remains fully inflated even when empty.

This latter consideration highlights another difference between the present device and that disclosed by Hawk. His bin was designed to be filled by gravity. The present silo is designed for filling pneumatically, for which reason the ventilator 24 is an essential feature of the present invention to enable the excess air to escape. By the same token the present device is emptied pneumatically, for which reason there is no need to provide any mechanism similar to that shown by Hawk for hoisting a part of the bag to cause the contents to flow towards the outlets.

Another essential aspect of the present invention is the grid of interconnected bands of flexible material, preferably webbing material, which form the third element of the combination. Flexible bags mounted in metal frames are known, but the present invention introduces a third element to provide a system with three distinct components. While Hawk provides straps to reinforce the lower walls of his bag, these are sewn to and form part of the bag. In the present arrangement, the grid of bands 14, 15 is a separate component that serves to provide the bag with additional support, i.e. limiting the bulging that the bag would otherwise experience between the posts 12, while at the same time permitting the bag freedom of motion relative to the bands.

Use of the grid of bands 14, 15 thus avoids any need for additional metal frame members between the corner posts, as would otherwise be necessary to contain the bag.

The separate and distinct nature of the three components of the present system enables any one of them to be replaced without it being necessary to replace the others.

I claim:

1. A flexible bag silo for bulk storage of granular material, comprising (a) a generally rectangular metal frame defining an open-bottomed peripheral framework adapted to be free standing on a firm horizontal floor;

(b) a grid of interconnected bands of flexible material extending between parts of said frame; and (c) a flexible bag confined by said frame and said grid while resting on the floor, said bag having at least one filling tube near the top thereof, at least one discharge tube at a side of the bag near the bottom thereof to enable discharging of the bag while so resting on the floor, and a ventilator opening near the top thereof;

(d) wherein said frame is formed of vertical posts, horizontal upper and lower bars and means for connecting said posts and bars, said means being capable of being readily assembled and disassembled to permit said posts and bars to be placed in a storage condition, said bands of flexible material extending horizontally and vertically between said posts and bars respectively, said bands being collapsible to facilitate disassembly to said storage condition; and (e) wherein said horizontal upper bars form a peripheral structure defining a horizontal plane, a series of suspension means serving to support the upper periphery of said bag from said peripheral structure.

2. A silo according to claim 1, wherein said suspension means are elastic.

3. A silo according to claim 1, including means for securing bottom corners of the bag to bottom corners of the frame as defined by the posts and lower bars.

4. A flexible bag silo for bulk storage of granular material, comprising (a) a generally rectangular metal frame formed of vertical posts, horizontal upper and lower bars and means for connecting said posts and bars to define an open-bottomed peripheral framework adapted to be free standing on a firm horizontal floor, said means being capable of being readily assembled and disassembled to permit said posts and bars to be placed in a storage condition;

(b) a grid of interconnected bands of flexible material extending between the posts and bars of said frame, said bands being collapsible to facilitate disassembly to said storage condition;

(c) a flexible bag confined by said frame and said grid while resting on said floor, said bag having at least one filling tube near the top thereof, at least one discharge tube at a side of the bag near the bottom thereof to enable discharging of the bag while so resting on the floor, and a ventilator opening near the top thereof; and (d) pneumatic means for blowing granular material into said bag through a said filling tube and for withdrawing such material from the bag through a said discharge tube.

5. A silo according to claim 4, wherein a screen extends across said ventilator opening.

6. A silo according to claim 4, wherein said horizontal upper bars form a peripheral structure defining a horizontal plane, a series of suspension means serving to support the upper periphery of said bag from said peripheral structure.

7. A silo according to claim 4, wherein said bag is formed of woven polyolefin material.

8. A silo according to claim 7, wherein said woven polyolefin material has a tensile strength of from about 130 to about 200 pounds per square inch, a tear strength of from about 40 to about 46 pounds, a puncture strength of from about 105 to about 145 pounds and a weight of from about 4 to about $5\frac{1}{2}$ ounces per square yard.

9. A silo according to claim 8, having a height of about 12 feet, horizontal dimensions of about 8 feet and a capacity to store at least 20,000 pounds of granular material.

10. A silo according to claim 4, wherein said horizontal bands are spaced more closely together adjacent the bottom of the frame than adjacent the top.

11. A flexible bag silo for bulk storage of granular material, comprising (a) a generally rectangular metal frame formed of vertical posts, horizontal upper and lower bars and means for connecting said posts and bars to define an open-bottomed peripheral framework adapted to be free standing on a firm horizontal floor, said means being capable of being readily assembled and disassembled to permit said posts and bars to be placed in a storage condition;

(b) a grid of interconnected bands of flexible material extending between the posts and bars of said frame, said bands being collapsible to facilitate disassembly to said storage condition; and (c) a flexible bag confined by said frame and said grid while resting on said floor, said bag having at least one filling tube near the top thereof, at least one discharge tube at a side of the bag near the bottom thereof to enable discharging of the bag while so resting on the floor, and a ventilator opening near the top thereof.

* * * * *